US011642600B2

(12) United States Patent
Thompson et al.

(10) Patent No.: US 11,642,600 B2
(45) Date of Patent: May 9, 2023

(54) TODDLER BUCKET SWING

(71) Applicant: Frustration Free Solutions, LLC, Twin Falls, ID (US)

(72) Inventors: Nathan Thompson, Twin Falls, ID (US); Jimmy Morrison, Springville, UT (US)

(73) Assignee: FRUSTRATION FREE SOLUTIONS, LLC, Twin Falls, ID (US)

( * ) Notice: Subject to any disclaimer, the term of this patent is extended or adjusted under 35 U.S.C. 154(b) by 0 days.

(21) Appl. No.: 16/945,493

(22) Filed: Jul. 31, 2020

(65) Prior Publication Data

US 2020/0360825 A1 Nov. 19, 2020

Related U.S. Application Data

(63) Continuation-in-part of application No. 29/682,707, filed on Mar. 7, 2019, now Pat. No. Des. 892,251.

(51) Int. Cl.
*A63G 9/00* (2006.01)

(52) U.S. Cl.
CPC ..... *A63G 9/00* (2013.01)

(58) Field of Classification Search
CPC ... A63G 9/00; A63G 9/02; A63G 9/12; A47D 13/00; A47D 13/02; A47D 13/10; A47D 13/102
USPC ..... 472/118–125; 297/273, 275, 281, 385
See application file for complete search history.

(56) References Cited

U.S. PATENT DOCUMENTS

| | | | | |
|---|---|---|---|---|
| 4,510,634 | A * | 4/1985 | Diedrich | A47D 13/02 297/256.15 |
| 6,648,411 | B2 * | 11/2003 | Julien | A47D 13/105 297/273 |
| 7,175,535 | B1 * | 2/2007 | Marmentini | A47D 13/025 297/273 |
| 7,578,746 | B1 * | 8/2009 | Johnson | A63G 9/00 297/485 |
| 8,899,688 | B2 * | 12/2014 | Brown | A47D 13/105 297/467 |
| 2006/0061166 | A1 * | 3/2006 | Bolland | A63G 9/00 297/281 |
| 2011/0241398 | A1 * | 10/2011 | Brown | A63G 9/00 297/344.21 |

* cited by examiner

*Primary Examiner* — Kien T Nguyen
(74) *Attorney, Agent, or Firm* — Dentons Durham Jones Pinegar

(57) ABSTRACT

A swing system may include a bucket-style swing seat, with a front support portion and a back support portion. A grip may be provided at the top edge of the outer face of the swing. The back support portion of the swing may have a height greater than the front support portion, and this high molded backing may also be provided with a top edge that curves outwardly. The high-molded backing may provide additional comfort for a child in the swing, as well as a grip for the caregiver pushing the swing.

19 Claims, 10 Drawing Sheets

TODDLER BUCKET SWING

PRIORITY CLAIM

This application is a continuation-in-part of U.S. design application Ser. No. 29/682,707, filed Mar. 7, 2019, the disclosure of which is incorporated by reference herein in its entirety.

TECHNICAL FIELD

This disclosure relates generally to a swing for children. More specifically, this disclosure relates to a bucket-style swing that can be mounted onto a play structure, such as a conventional A-frame swing set, for use by children.

BACKGROUND

Play sets for children are well-known as they can be useful for recreation and occupational therapy for children. Swing sets are common, both because children enjoy them for recreational use and because swinging is beneficial for children's sensorial development. Swinging increases spatial awareness, helps develop gross and fine motor skills, and helps develop balance.

Many different types of children's swings have been developed, especially with the recent interest in increasing the safety of swings and playground equipment. The most common swing set configuration employed on both public and private playgrounds involves an A-frame construction having two A-frame vertical supports attached at their apex by an elongated horizontal bar from which are suspended one or a plurality of swings or other pieces of equipment. Common types of swings which may be suspended include classic seat swings, half-bucket swings, full-bucket swings, and, more recently, spider-web or nest-type swings. Full-bucket style swings are considered the safest for small children, as they are very difficult for a child to fall out of due to a back support portion and a front support portion in addition to the bottom swing seat. Full-bucket style swings are in contrast, for example, to "open" or classic seat swings which provide only a bottom seat, without a back or a front support portion.

Standard full-bucket style swings may allow a user to place their child in the swing, and the child may hold onto the chain that the swing is suspended by. No handles or grip are provided on the front support portion of the swing. Additionally, full-bucket style swings are typically identical on their front and back. While this may allow the swing to be used with the child facing in either direction, it does not provide additional back support to the child, nor convenient means for the parent to grip, catch, or push the swing from the back. It also may make it more difficult for a parent to place the child in the swing because the front support portion and the back support portion are both substantially vertical with respect to the seat. Thus, the child must be placed in the swing from the top, entering the swing from a substantially vertical angle. Depending on the height and weight of the child this may be awkward and/or physically difficult for the caregiver.

The following description provides the ability to overcome the shortcomings of current swing systems.

SUMMARY

This disclosure relates to a swing system which may comprise a swing, the swing comprising a seat formed of a bottom portion connected to a front support portion and a back support portion; the front support portion comprising an upper, lateral support, and a medial support connecting the upper, lateral support to the bottom portion of the seat; a first space between the bottom portion, the medial support, and the upper, lateral support forming a first forward leg opening, and a second space between the bottom portion, the medial support, and the upper, lateral support forming a second forward leg opening; the front support portion having a first height and the back support portion having a second height, the second height of the back support portion greater than the first height of the front support portion; the upper, lateral support of the front support portion having a top edge, an inner face and an outer face, the inner face facing a child when the child is positioned in the seat, and the outer face facing away from the child when the child is positioned in the seat; the upper, lateral support of the front support portion comprising a semi-circular projection proximal to the top edge of the outer face, the semi-circular projection forming a grip, the grip extending across a width of the outer face, from a left side of the seat to a right side of the seat; the back support portion comprising a rear upper, lateral support, and a rear medial support connecting rear upper, lateral support to the bottom portion of the seat; and the rear upper, lateral support having a rear top edge, and the rear upper, lateral support comprising a lip extending outwardly at the rear top edge forming a back rest.

According to one aspect, the bottom portion, the front support portion, and the back support portion may be formed of a unitary piece. For example, the swing may be molded in a unitary piece.

According to another aspect, the swing system may further comprise a first bracket attached to the left side of the seat and a second bracket attached to the right side of the seat. The system may also include a first anchor connected to the first bracket and a second anchor connected to the second bracket, the swing seat suspended by the first anchor and the second anchor.

According to another aspect, the second height if the back support portion is about 1.2 to about 1.3 times greater than the first height. For example, the second height may be from about 10 inches to about 16 inches. The distance from the front support portion to the back support portion may be from about 12 inches to about 16 inches.

In some configurations, the swing seat may be suspended by a first support bracket connected at a top side of the left side of the seat, and a second support bracket connected at the top side of the right side of the seat. According to yet another aspect, the system may further comprise a first connector attaching the first anchor to a first chain, the first anchor, the first connector, and at least part of the first chain covered in a contiguous plastic polymer coating.

In other configurations described herein, a swing system may comprise: a swing seat comprising a front support portion in connection with a back support portion; the front support portion comprising a top edge and an outer face, with an grip extending outwardly proximal to the top edge of the outer face of the front support portion; wherein the front support portion has a front height and the back support portion has a back height, the back height greater than the front height; and the back support portion comprising a back top edge, the back top edge curving outwardly forming a lip. The grip extending outwardly may comprise a semi-circular projection extending from a left side of a front side of the swing seat to a right side of the front side of the swing seat. The grip may extend across the width of the swing front side.

The swing system may further comprise a first support bracket connected to the left side of the swing seat, and a second support bracket connected to the right side of the swing seat; and a first triangular anchor connected to the first support bracket and a second triangular anchor connected to the second support bracket.

According to yet another aspect, a method of providing a swing system is described, the method comprising: forming a swing seat, the a swing seat comprising a front support portion in connection with a back support portion; providing a grip projecting outwardly at a top edge of a front side of the front support portion; and providing an outwardly curving back support at the back support portion. The step of providing the grip extending outwardly at the top edge of the front side of the front support portion may comprise forming a semi-circular projection at the top edge of the front side of the front support portion, the semi-circular projection extending from a left side of the front support portion to a right side of the front support portion. The method may also comprise the step of attaching a first anchor to a left side of the swing seat via a first bracket, and attaching a second anchor to a right side of the swing seat via a second bracket.

DESCRIPTION

Figure 1:
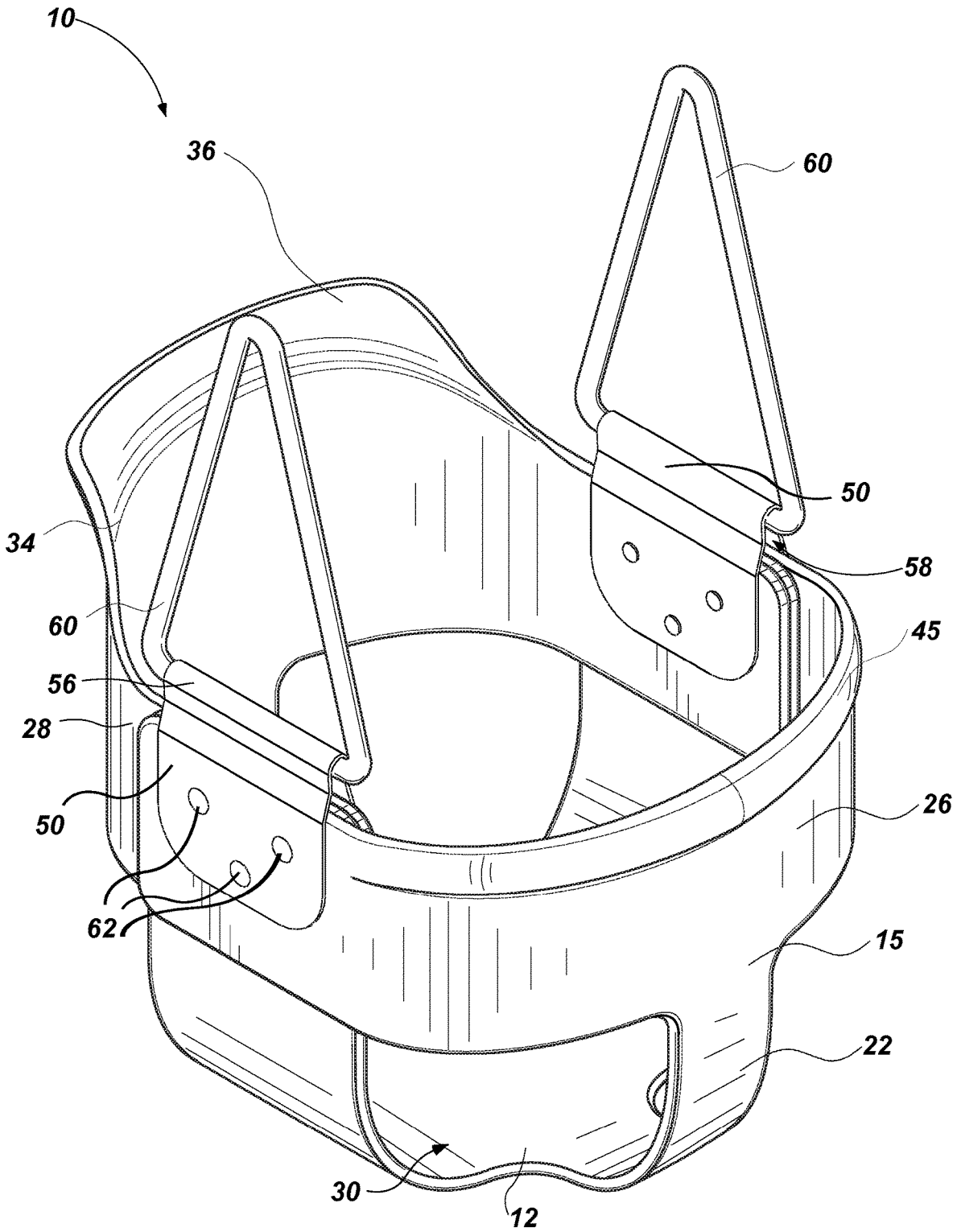
FIG. 1 illustrates a perspective view of a swing system as described herein.
Figure 2:
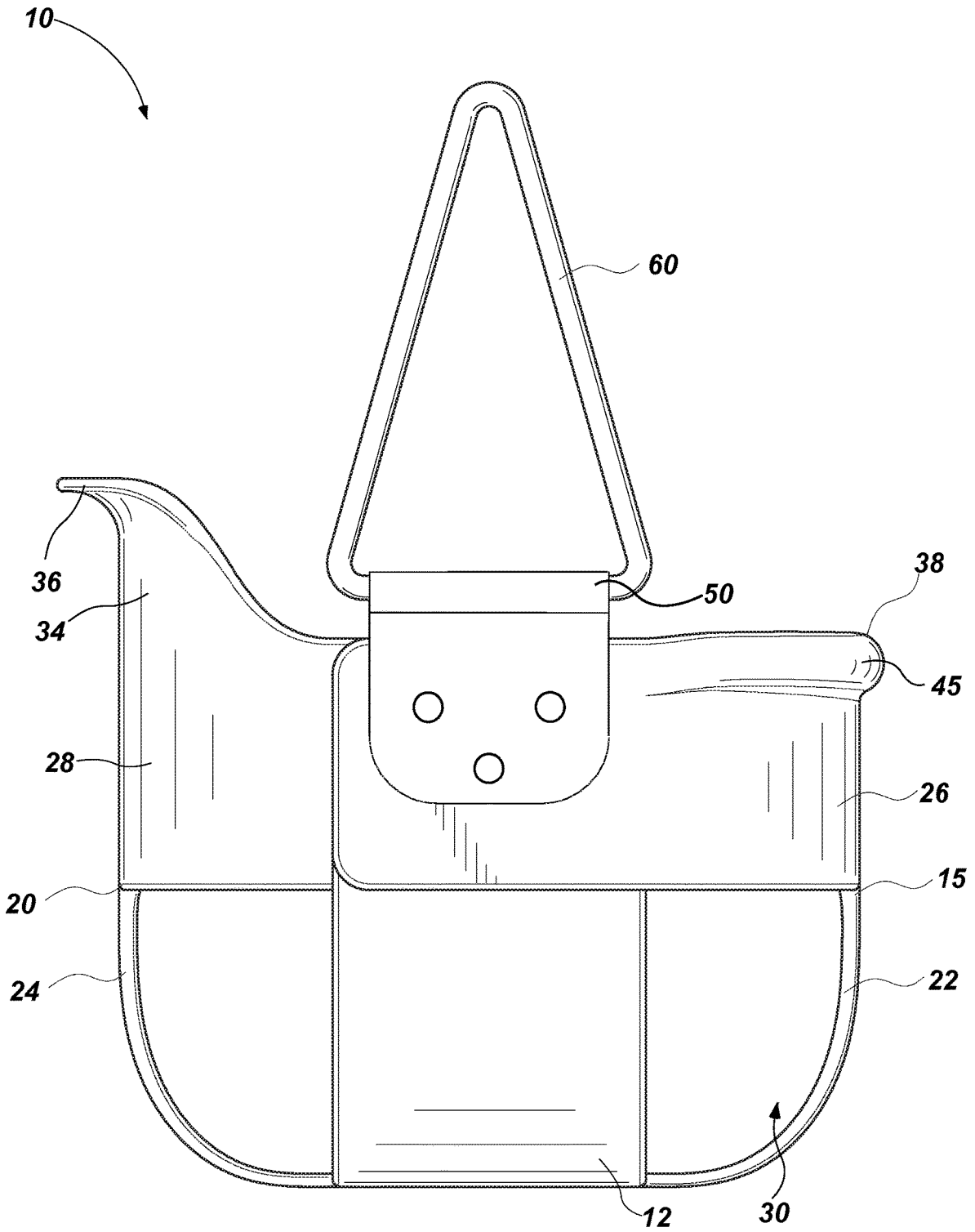
FIG. 2 is a right side view of FIG. 1.
Figure 3:
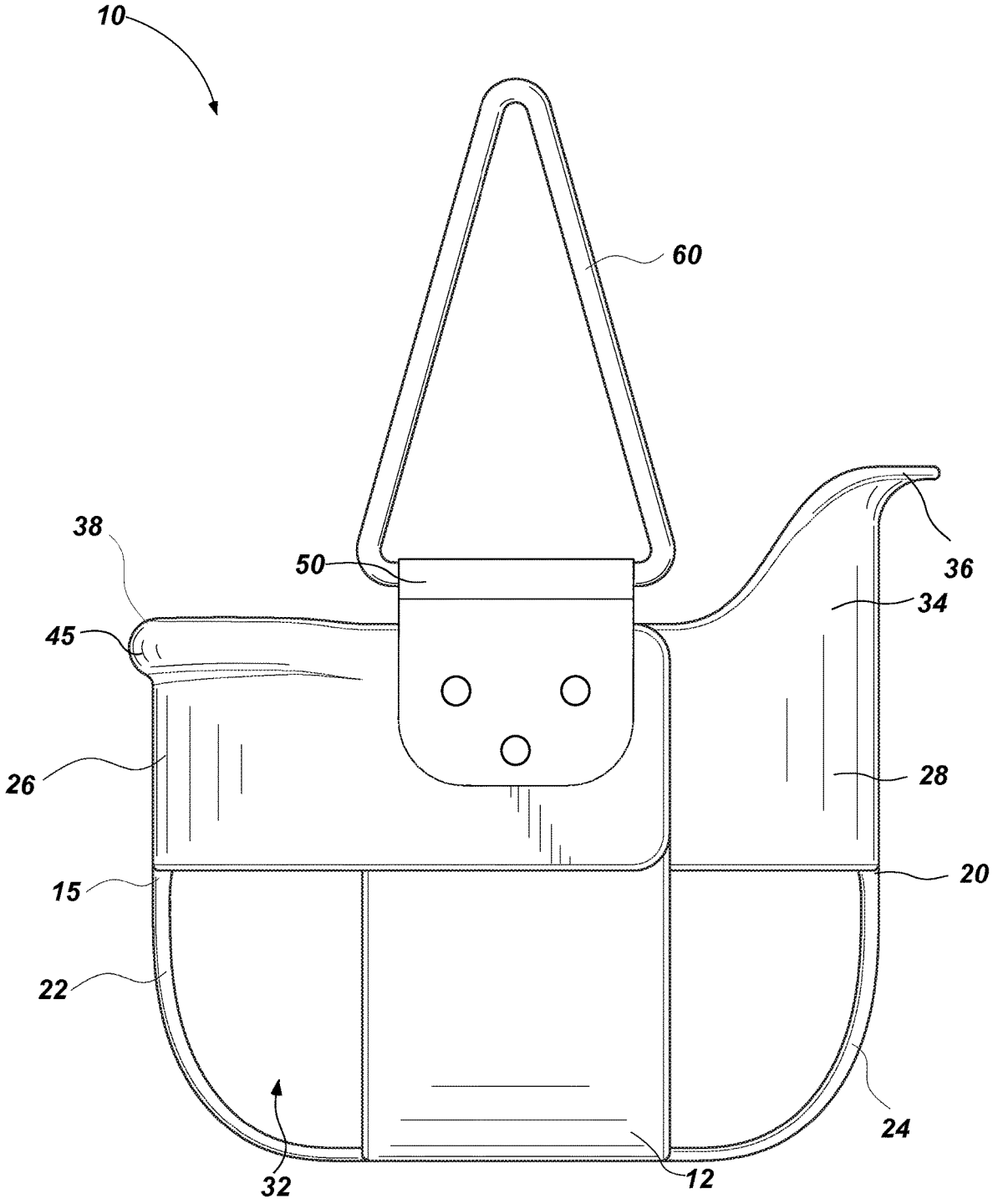
FIG. 3 is a left side view of FIG. 1.
Figure 4:
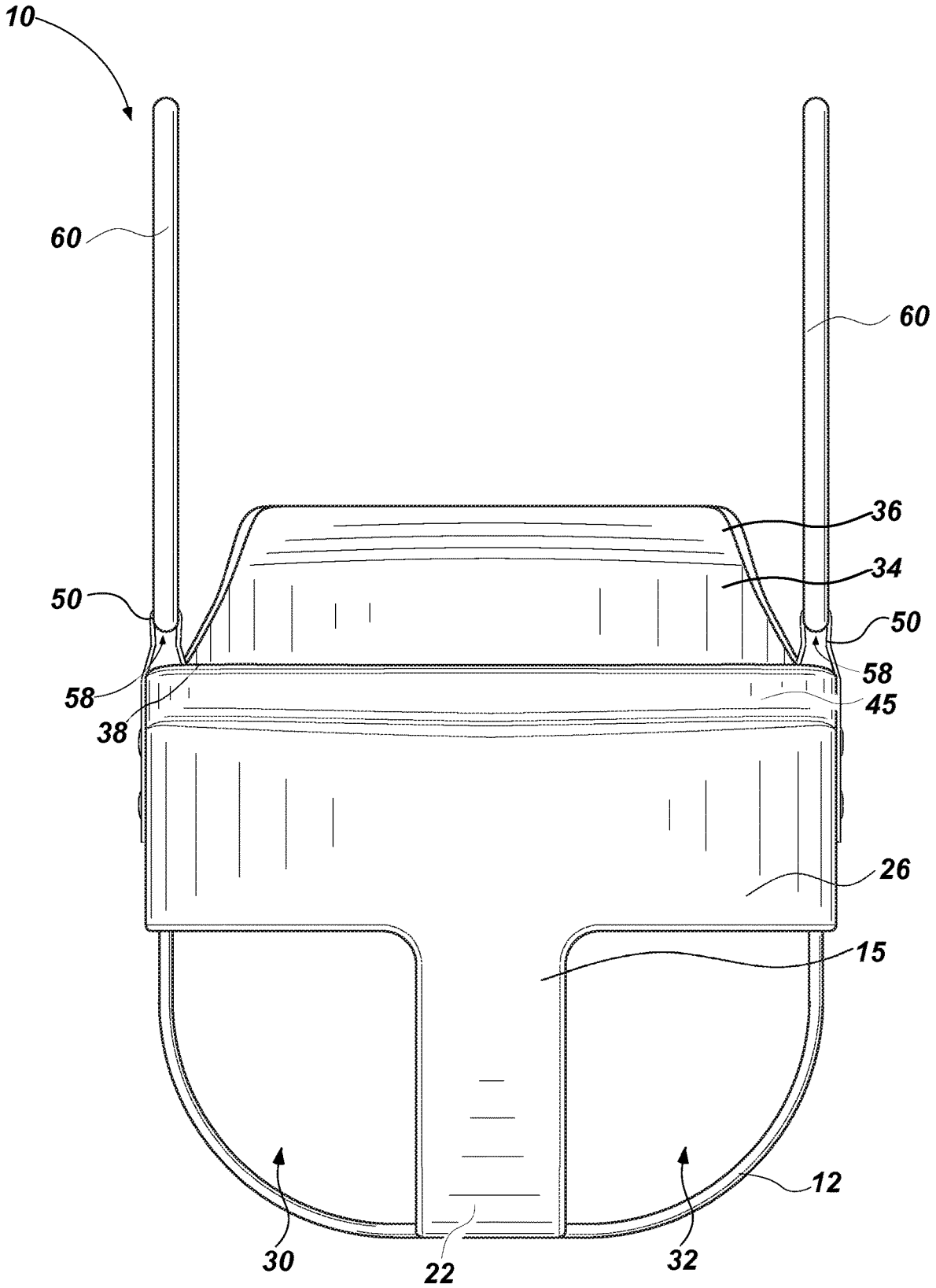
FIG. 4 is a front view of FIG. 1.
Figure 5:
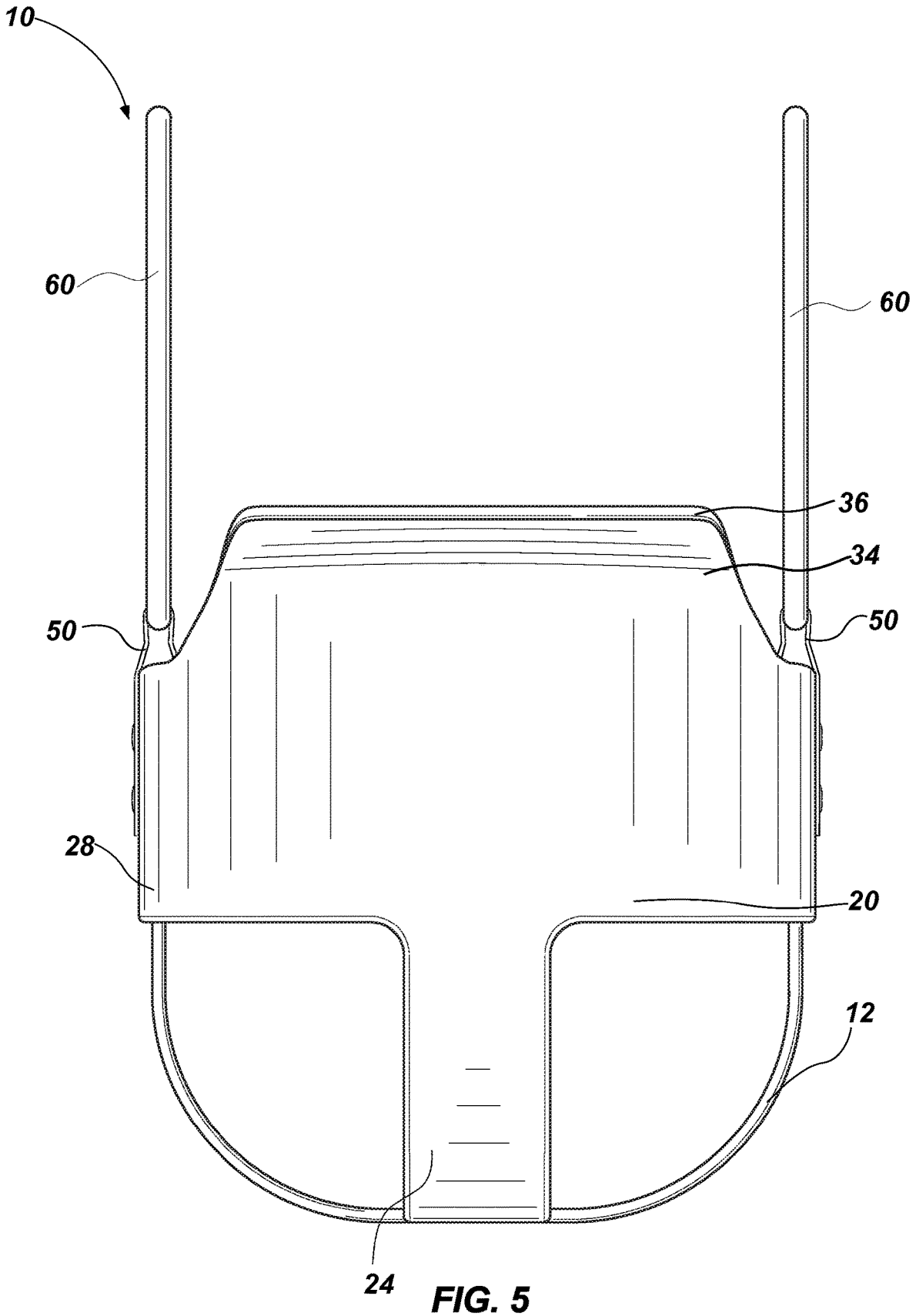
FIG. 5 is a back view of FIG. 1.
Figure 6:
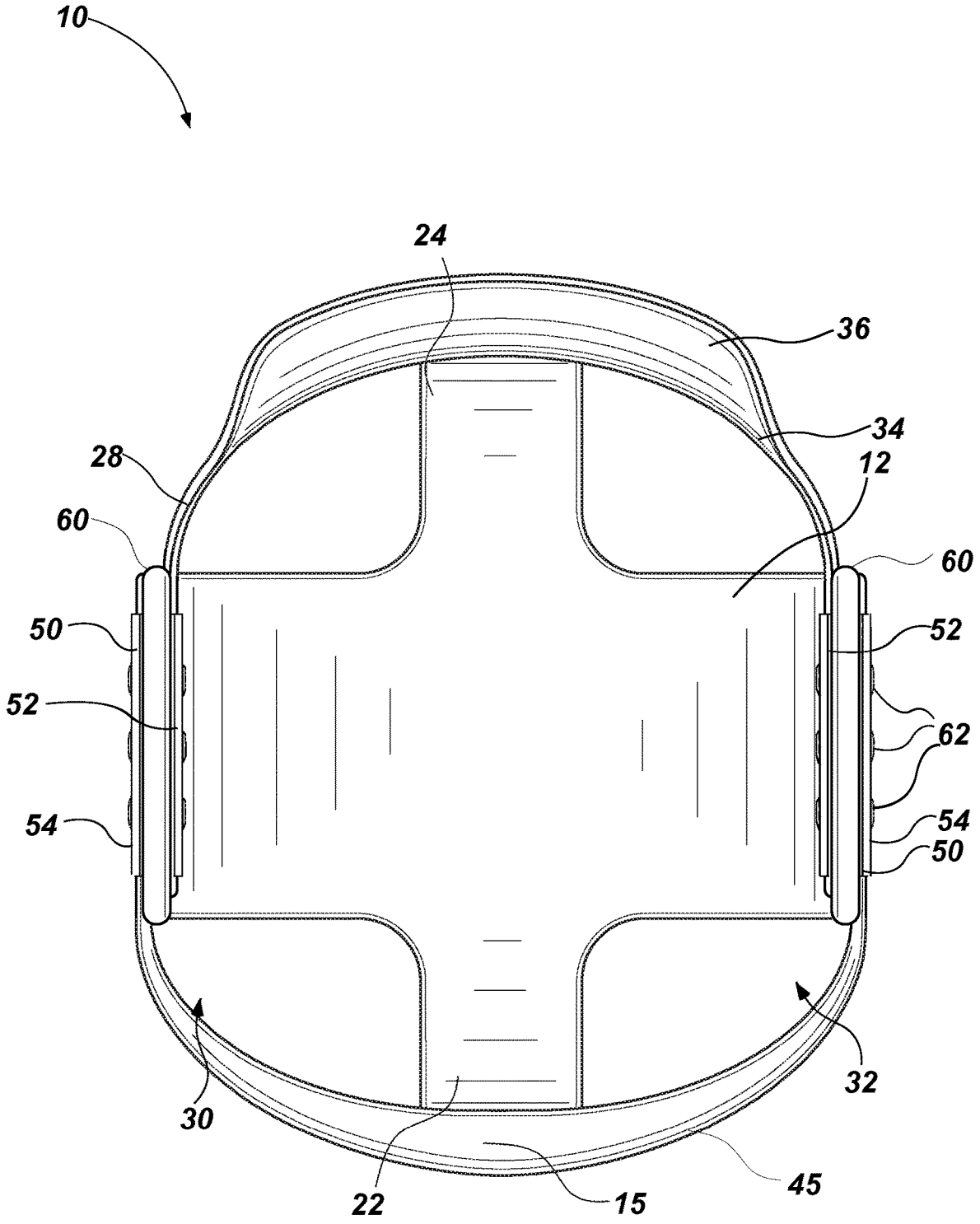
FIG. 6 is a top view of FIG. 1.
Figure 7:
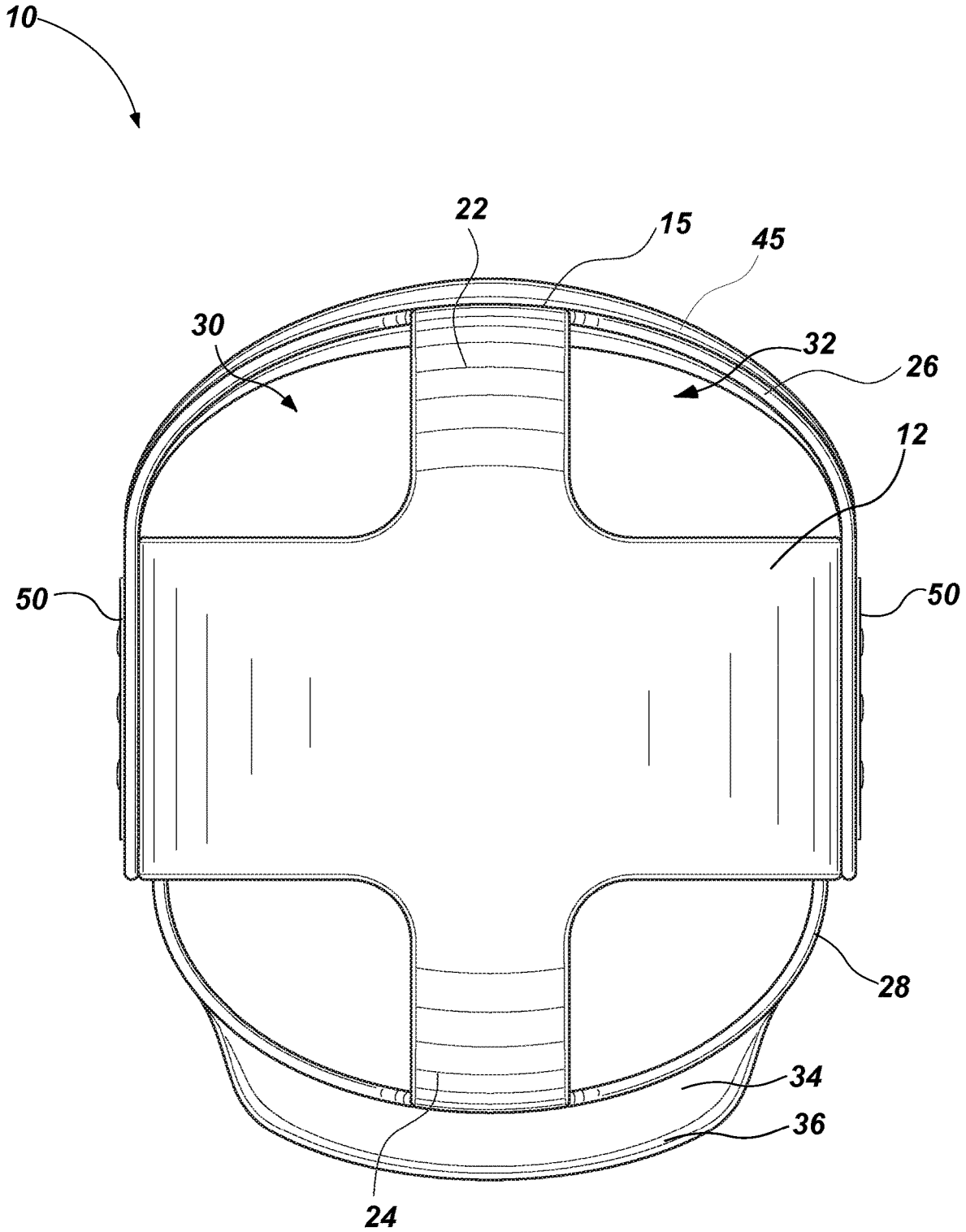
FIG. 7 is a bottom view of FIG. 1.

The following description sets forth the system and use of swings, and more specifically, bucket-style swings for babies, toddlers, and small children. The swing may be mounted in a variety of configurations, such as on a traditional A-frame swing set or other swing structure, or on a tree limb. The disclosure generally refers to the swing system as being for a child, but it will be appreciated that the swing system may be used by a person of any age, if they are the appropriate size and weight for the swing.

FIGS. 1-7 illustrate a bucket swing according to the present disclosure. The swing may be generally formed of swing seat 10, which includes a bottom portion 12 connected to a front support portion 15 and a back support portion 20. The front support portion 15 and back support portion 20 may be formed in a variety of configurations. In the configuration shown in FIGS. 1-10, each of the front and back support portions 15, 20 include a medial support (medial support 22 on front support portion 15 and rear medial support 24 on back support portion 20), and an upper, lateral support (upper, lateral support 26 on front support portion 15 and upper, lateral support 28 on back support portion 20) connected to the medial support. The upper, lateral supports 26, 28 may each wrap around toward the center of the swing and connect to a side of the bottom portion 12. This configuration leaves two forward spaces between the bottom portion 12, the medial support 22, and the upper, lateral support 26, forming two forward leg openings 30, 32. The two forward leg openings may receive a child's legs when they are seated in the seat portion of the swing. While this disclosure generally describes portions of the swing seat as being connected to each other, it will be appreciated that in some configurations the swing seat 10 is formed of a single unitary piece. In some configurations, it may be advantageous to form the bottom portion 12, front support portion 15, and back support portion 20 of a unitary piece, as it may allow for simpler and easier manufacturing. A unitary piece may also be safer as it has no movable parts, requires no additional locking mechanism to keep the child in the seat, and may also last longer. The swing seat 10 as shown in FIGS. 1 through 10 may also generally include a front side 6, a back side 8, a left side 14, and a right side 18.

The back support portion 20 of the swing is attached to or formed integrally with the bottom portion 12 of the swing and may prevent a child in the seat from falling backward out of the swing seat. The upper, lateral support 28 of the back support portion 20 may be connected to the bottom portion 12 of the swing via the rear medial support 24. The upper, lateral support 28 of the back support portion 20 may include a high molded backing 34. In some configurations, the high molded backing 34 may also be provided with a generally outward curve 36 or lip.

The outward curve or lip 36 of the back support portion 20 may make it easier for a caregiver to place the child into the swing seat and/or remove the child from the swing seat. The lip 36 may also provide a handle for the caregiver to grip the swing from the back, such as when they are holding the swing in place to position a child in the seat portion, when they must hold the swing to slow it down, or when then are pushing the swing to swing the child. Furthermore, the outward curve and/or higher back of the back support portion 20 may provide an aesthetic feature that is more appealing to a user.

The back support portion 20 may have also have a height that is greater than the front support portion, and this may provide additional back support for the child in the swing and may also increase the comfort of the swing for a child user. In some configurations, the back height is about 1.1 to about 1.5 times greater than the front height. More specifically, the back height may be about 1.2 to about 1.3 times greater than the front height. For example the back height may be about 25 centimeters to about 41 centimeters (or about 10 inches to about 16 inches). The distance from the front support 15 to the back support 20 may from about 30 centimeters to about 41 centimeters (or about 12 inches to about 16 inches).

Figure 8:
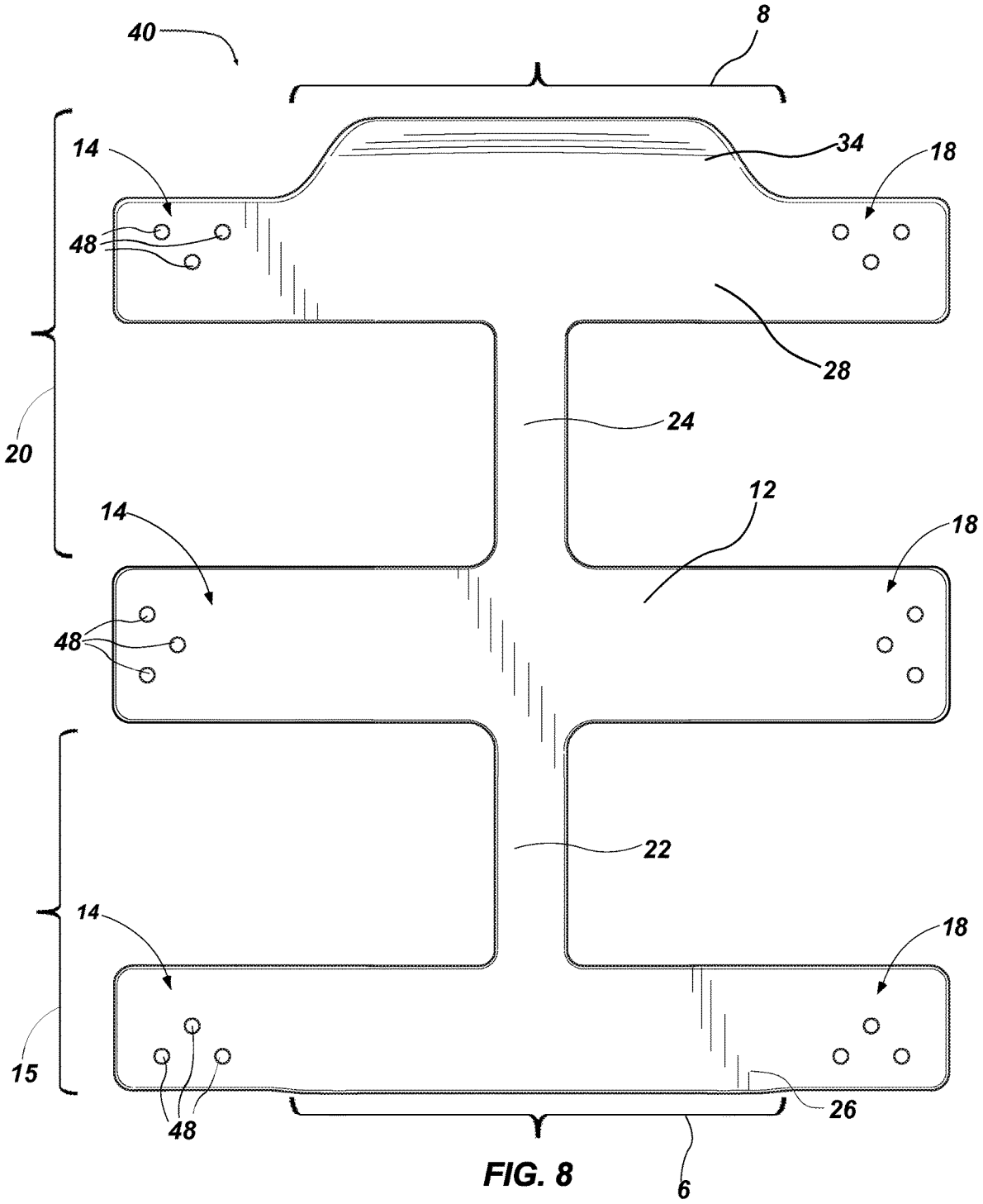
FIG. 8 is a top view of the inner face of the swing seat as described herein.
Figure 9:
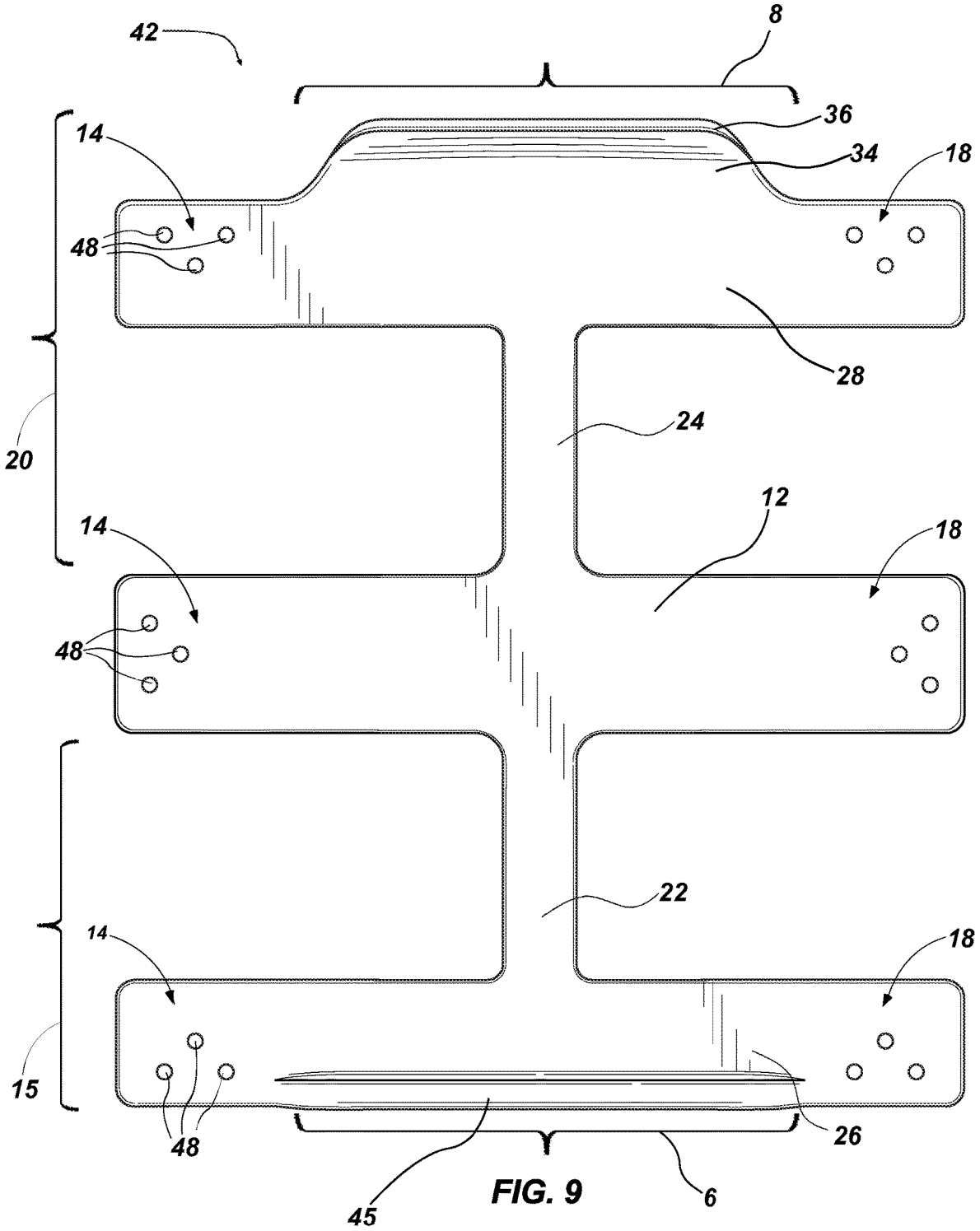
FIG. 9 is a top view of the outer face of the swing seat as described herein.

The high molded backing 34 may extend across a width of the back side 8 of the swing seat 10, from the left side 14 of the swing seat to the right side 18 of the swing seat. FIGS. 8 and 9 show the swing seat laid flat before it is connected, and the back side 8 of the swing is seen, extending from the left side 14 to the right side 18, with the high molded backing 34 extending across substantially the entire width of the back side 8. The lip or outward curve 36 may also extend across substantially the entire width of the back side 8 of the swing 10.

The front support portion 15 of the swing is attached or formed integrally with the seat portion of the swing, and is designed to prevent a child in the seat portion from falling forward out of the swing. The front support portion may generally include a medial support 22 connecting the bottom portion 12 of the swing to the upper, lateral support 26. The upper, lateral support 26 may include a top edge 38, an inner face 40 and an outer face 42. The inner face 40 may face the child (at the anterior side of the child's torso) when the child is positioned in the swing seat, and the outer face 42 may face away from the child when the child is positioned in the swing seat.

In some configurations, the front support portion 15 of the swing may further comprise a grip 45 for the child to grip when they are seated in the swing. The grip may be positioned in any suitable location for the child's hands to grasp while they are seated in the swing. For example, a rounded grip 45 may be provided on the outer face 42, at or near the top edge 38 of the outer face. More specifically, a semi-circular projection or horizontal cylindrical segment may be provided as the grip 45. Other suitable shapes may also be used. In other configurations, the grip 45 may be molded to further facilitate a comfortable and safe grip for the child. In still yet other configurations, one grip may be provided near the middle of the outer face for both of the child's hands. Alternatively, two separate grips may be provided, one for each of the child's hands. In yet other configurations, multiple grips such as two or more may be provided to allow different hand positions for the child's hands. For example, a single grip may extend across a width of the front side 6 of the swing seat 10, from the left side 14 of the swing seat to the right side 18 of the swing seat, providing a plurality of different gripping positions across the front surface. FIGS. 8 and 9 show the swing seat laid flat before it is connected, and the front side 6 of the swing is seen, extending from the left side 14 to the right side 18.

In other configurations, one or more sets of grips may be provided, such as a smaller set of grips proximal to the middle of the swing, and a larger set of grips outwardly from the smaller set, so children with different hand sizes can use different sets of grips. Alternatively, a single grip with a graduated thickness may be used. It will be appreciated that different shapes, sizes, and lengths of the grip(s) are considered and contemplated herein. The alternative embodiments of the front surface grip(s) may provide more or less surface area to hold.

The grip 45 may generally allow a child seated in the swing to place their palms and/or fingers at the top edge 38 of the front support portion 15 and curve their fingers around the grip 45 at the outer face 42 of the front support portion 15. The grip 45 may provide other advantages in addition to a surface for the child seated in the swing to grasp. A caregiver located at the front of the swing may use the grip 45 to control movement of the swing. For example, the grip 45 may allow a caregiver pushing the child from the front of the swing an additional grip to hold when grasping the swing to slow it down or when grasping the swing to provide additional pushing force.

The swing may be generally formed of a single piece of molded rubber, or other suitable material, as seen in FIGS. 8-9. The swing may be formed by positioning the right side of the upper, lateral support 28 of the back support portion 20 such that it overlaps with the right side of the bottom portion 12, and further positioning the right side of the upper, lateral support 26 of the front support portion 15 such that it also overlaps the right side flap of the bottom portion 12. Holes 48 may be formed through all three layers to connect the right sides of the upper, lateral support of the front and back supports to the right side of the bottom portion (see FIGS. 8-9). Such holes 48 may be formed as part of the molded swing, or may be created after the swing portion is molded. A bracket 50 may be provided on each of the left and right sides, as described in more detail below, to secure the right side. The left side of the swing may be connected in a similar manner. It will be appreciated that this is a typical configuration for a bucket-style swing for children, and other configurations may be used. The swing may be formed of any suitable material, such as polymer rubber, plastic, polypropylene copolymer, synthetic rubber, ethylene-propylene-diene-monomer (EPDM), etc. Other suitable materials may be used also. In one specific configuration, the swing is formed of 5/16" thick EPDM rubber which is known to be resistant to cracking, oxidizing, and crazing.

A bracket 50 may be provided on each side of the swing, both to hold the portions of the swing together as described above, and to attach an anchor 60 to the swing. The brackets 50 may include an inner plate 52 and an outer plate 54 connected at a joint 56 (FIG. 1). The bracket 50 may be formed of any suitable material, such as metal, galvanized steel, or other metal alloys. The joint 56 or coupling between the inner plate 52 and outer plate 54 may form a channel 58 or pocket to accept the anchor. For example, for a triangular anchor 60 as shown in FIG. 1, the inner and outer plates are connected at the joint 56 that has a generally circular-shape to accept the circular shape of the bottom portion of the triangular anchor 60. The portions of the swing seat which overlap (namely, the right side of the bottom 12; the right side of the rear upper, lateral support 28; and the right side of the front upper, lateral support 26) may be placed between the inner 52 and outer plate 54 of the bracket 50, and the inner and outer steel plates may then be riveted together. In the specific configuration shown in FIG. 1, three rivets 62 are provided on the right side of the swing seat and three rivets on the left side of the swing seat to attach the brackets 50 to the swing.

In addition to the bracket 50 on each side of the swing to hold the portions of the swing together, each side of the swing may also have an anchor 60 attached thereto for suspending the swing seat. The anchors 60 may be used to suspend the swing seat for swinging movement through a preferably arcuate path. The anchors 60 may be any suitable shape and may be formed from any suitable material. In some configurations, the anchors 60 may comprise triangular brackets. Even more specifically, the anchors may comprise acute isosceles triangles.

The anchors 60 may be formed of galvanized steel or other metal alloys, and each may be connected to the swing seat by a bracket 50 that is riveted to the swing seat as described above. The bracket 50 and/or the anchors 60 may be coated in a soft plastic or other suitable material to minimize sharp edges and/or points where children's fingers could be pinched, hair could be caught, etc., as described in more detail below.

Figure 10:
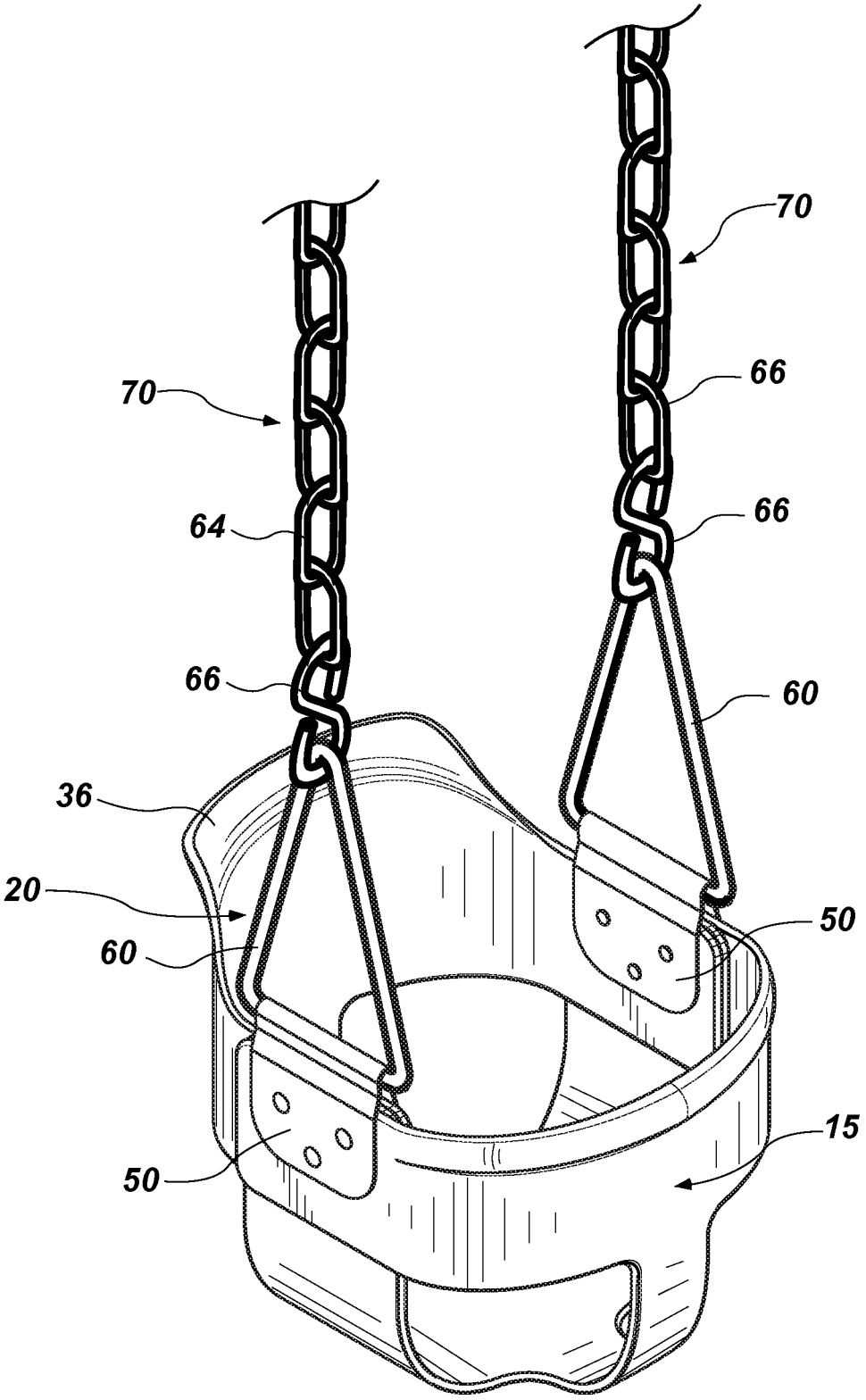
FIG. 10 is a perspective view of a swing system attached to chains for suspension.

The swing may be further suspended from two chains 64 attached to the anchors 60 (FIG. 10). The chain 64 may be attached to the anchor 60 by any suitable means. For example, a connector 66 such as an S-hook may be used. In other configurations, other types of conventional connectors such as a threaded quick link, a coupling link, or any other conventional hook, link, and/or fastener may be used as connector. In some configurations, each of the chains 64 may be at least partially coated in a plastic material, such as plastisol or any other conventional suitable material. More specifically, the chains 64, connector 66, and the anchor 60 may together be coated such that there is one substantially contiguous coating 70. The junction between the anchor 60, connector 66, and chain 64 in this type of configuration may be coated such that there is no slippage between the anchor, connector, and chain. Thus, there is no space for a child's fingers to be caught or pinched. In conventional, uncoated swings, the chain may rotate with respect to the arm support in use. As the chain rotates with respect to the arm support, a child who places their hands on the chain/arm support may have portions of the hand and/or fingers pinched. In other configurations, the chain, arm support, and the inner and/or outer plates of the bracket 50 may be coated.

Any suitable coating may be used. For example, a plastisol coating may be used. Plastisol coatings are typically applied as gels. As the plastisol gel coating solidifies, it provides the swing chain with a plastic-like texture. This may make the metal easier for children to hold onto the chain while they swing. It may also provide an aesthetic advantage as plastisol-coated chain can be brightly colored in many colors. The full length of the chain may be covered, or only links in the grip area may be covered. The plastisol-covered chain may reduce finger pinching, increasing safety of the swing. Similarly, a soft-grip type chain may be used, and/or a chain sleeve that encases the swing chain in a plastic covering. Plastisol, soft-grip chains, chain sleeves, etc., may allow children to grip chain more easily and provide a layer of protection against pinched fingers and chain corrosion.

In some configurations, prior to fixation of the chain assembly to the seat or fixation of the chain to the support structure, the triangular anchor, the S-hook and the chain may assembled together into the chain assembly. The chain assembly is then dipped or immersed into a polymer coating solution until each of the respective parts of the chain assembly are adequately coated. The coating may be allowed to dry after which the chain assembly is fixed to a seat with a bracket that engages the triangular anchor on a single side of the triangle.

The swing may be formed in any suitable manner known in the industry. For example, the swing may be formed by molding a single piece of rubber or polymer, or by molding separate pieces and connecting them. The mold may have the forms of the grip 45 and/or lip 36 formed in the mold, such that the swing is molded of a single unitary piece, including the grip 45 and/or lip 36. Swings molded of a single unitary piece may be less likely to break or wear over time.

In use, the swing 10 may first be hung from an appropriate support. For example, a substantially horizontal tree branch or a conventional A-frame swing set may be used to hang the swing. Typically two chains are used to suspend the seat portion of the swing. For example, two chains may be used, each of the two chains attached to one of the respective anchors. A user may first hang each of the two chains, and then attach one chain to each of the anchors via a connector. Once the swing is appropriately and securely hung from a support, a caregiver may lift a child and place them into the swing seat 10. As the child is lifted into the swing seat 10, the lip/outward curve 36 of the high molded backing 34 may encourage the child to be positioned into the seat 10 (as opposed to traditional swings, which do not have a curve and which it can be difficult to lift children into). As the child sits in the swing, they may rest their back against the high molded backing 34 for safety and comfort. The front support portion 15 may keep the child from falling forward out of the swing seat 10, and the back support portion 20 may ensure the child does not fall backward out of the swing seat 10.

Additionally, the child may grasp the grip 45 provided on the outer face 42 of the lateral support 26 of the front support portion 15. As a caregiver pushes the child in the swing, they may stand in front of the child and also use the grip 45 to push, and/or to grasp to slow the swing's movements. Similarly, the caregiver may stand at the rear of the swing and use the lip 36 to push and/or to grasp to slow the swing's movements. When the child is ready to be removed from the swing, the caregiver may more easily remove the child, as the generally outward curve/lip 36 may allow the caregiver to lift the child upwardly and rearwardly, rather than directly upwardly as with traditional bucket swings.

Although the foregoing disclosure provides many specifics, such as use of the system in conjunction with a bucket swing, it will be appreciated that other applications may be utilized for safety of swings, and these should not be construed as limiting the scope of any of the ensuing claims. Other embodiments and configurations may be devised which do not depart from the scopes of the claims. Features from different embodiments and configurations may be employed separately or in combination. Accordingly, all additions, deletions and modifications to the disclosed subject matter that fall within the scopes of the claims are to be embraced thereby. The scope of each claim is indicated and limited only by its plain language and the full scope of available legal equivalents to its elements.

The various embodiments described above, including elements of the various embodiments described above, can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

What is claimed:

1. A swing system comprising:

a swing comprising:

a seat formed of a bottom portion connected to a front support portion and a back support portion;

the front support portion comprising an upper, lateral support, and a medial support connecting the upper, lateral support to the bottom portion of the seat;

a first space between the bottom portion, the medial support, and the upper, lateral support forming a first forward leg opening, and a second space between the bottom portion, the medial support, and the upper, lateral support forming a second forward leg opening;

the front support portion having a first height and the back support portion having a second height, the second height of the back support portion greater than the first height of the front support portion;

the upper, lateral support of the front support portion having a top edge, an inner face and an outer face, the inner face facing a child when the child is positioned in the seat, and the outer face facing away from the child when the child is positioned in the seat;

the upper, lateral support of the front support portion comprising a projection proximal to the top edge of the outer face, the projection forming a grip, the grip extending across a width of the outer face, from a left side of the seat to a right side of the seat, wherein the projection comprises a closed, semi-circular projection forming a rounded grip;

the back support portion comprising a rear upper, lateral support, and a rear medial support connecting rear upper, lateral support to the bottom portion of the seat; and the rear upper, lateral support having a rear top edge, and the rear upper, lateral support comprising a lip extending outwardly and non-parallel from the back support portion, at the rear top edge and extending the opposite direction as the grip.

2. The swing system of claim 1, the bottom portion, the front support portion, and the back support portion formed of a unitary piece.

3. The swing system of claim 1, further comprising a first bracket attached to the left side of the seat and a second bracket attached to the right side of the seat.

4. The swing system of claim 3, further comprising a first anchor connected to the first bracket and a second anchor connected to the second bracket, the seat suspended by the first anchor and the second anchor.

5. The swing system of claim 4, further comprising a first connector attaching the first anchor to a first chain, the first anchor, the first connector, and at least part of the first chain covered in a contiguous plastic polymer coating.

6. The swing system of claim 1, wherein the bottom portion, the front support portion, and the back support portion are molded as a unitary piece.

7. The swing system of claim 1, wherein the second height is about 1.2 to about 1.3 times greater than the first height.

8. The swing system of claim 1, wherein the second height is from about 10 inches to about 16 inches.

9. The swing system of claim 1, wherein a distance from the front support portion to the back support portion is from about 12 inches to about 16 inches.

10. The swing system of claim 1, wherein the seat is suspended by a first support bracket connected at a top side of the left side of the seat, and a second support bracket connected at the top side of the right side of the seat.

11. A swing system comprising:

a swing seat comprising a front support portion in connection with a back support portion;

the front support portion comprising a top edge and an outer face, with a grip extending outwardly proximal to the top edge of the outer face of the front support portion, wherein the grip comprises a semi-circular projection forming a closed, rounded grip;

wherein the front support portion has a front height and the back support portion has a back height, the back height greater than the front height; and the back support portion comprising a back top edge, the back top edge curving outwardly forming a lip, the lip extending non-parallel from the back support portion and extending the opposite direction as the grip, wherein the lip is configured for a caregiver to hold on to from the back support of the swing seat.

12. The swing system of claim 11, the back support portion and the front support portion of the swing seat formed of a unitary piece.

13. The swing system of claim 11, wherein the back height is about 1.1 to about 1.4 times the front height.

14. The swing system of claim 11, wherein the grip extends from a left side of a front side of the swing seat to a right side of the front side of the swing seat.

15. The swing system of claim 11, wherein the swing seat further comprises a left side and a right side;

a first support bracket connected to the left side of the swing seat, and a second support bracket connected to the right side of the swing seat; and a first triangular anchor connected to the first support bracket and a second triangular anchor connected to the second support bracket.

16. The swing system of claim 11, further comprising a swing front side having a width, the grip extending across the width of the swing front side.

17. A method of providing a swing system, comprising:

forming a swing seat, the a swing seat comprising a front support portion in connection with a back support portion;

providing a grip projecting outwardly at a top edge of a front side of the front support portion, wherein the grip comprises a semi-circular projection forming a closed, rounded grip; and providing an outwardly curving back support at the back support portion the back support portion comprising a back top edge, the back top edge curving outwardly forming a lip, the lip extending non-parallel from the back support portion and extending the opposite direction as the grip, wherein the lip is a handle configured for a caregiver to hold to from the back support of the swing seat.

18. The method of claim 17, wherein the step of providing the grip extending outwardly at the top edge of the front side of the front support portion comprises the semi-circular projection extending from a left side of the front support portion to a right side of the front support portion.

19. The method of claim 17, further comprising the step of attaching a first anchor to a left side of the swing seat via a first bracket, and attaching a second anchor to a right side of the swing seat via a second bracket.

* * * * *